US009872092B2

(12) United States Patent
Han et al.

(10) Patent No.: US 9,872,092 B2
(45) Date of Patent: Jan. 16, 2018

(54) SPEAKER DEVICE AND ELECTRONIC DEVICE INCLUDING THE SAME

(71) Applicant: Samsung Electronics Co., Ltd., Gyeonggi-do (KR)

(72) Inventors: Jung-Eun Han, Gyeonggi-do (KR); Ki-Won Kim, Gyeonggi-do (KR); Myung-Cheol Lee, Gyeonggi-do (KR); Sun-Young Lee, Gyeonggi-do (KR); Young-Bae Ji, Gyeonggi-do (KR); Jin-Hyuk Choi, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/594,236

(22) Filed: Jan. 12, 2015

(65) Prior Publication Data

US 2015/0201258 A1 Jul. 16, 2015

(30) Foreign Application Priority Data

Jan. 13, 2014 (KR) ..... 10-2014-0003991

(51) Int. Cl.
*H04R 1/02* (2006.01)
*H04R 1/28* (2006.01)

(52) U.S. Cl.
CPC ..... *H04R 1/023* (2013.01); *H04R 1/2811* (2013.01)

(58) Field of Classification Search
CPC .... H04M 1/035; H04M 1/04; H04M 1/72519; H04R 1/02; H04R 1/021; H04R 1/225; H04R 1/26; H04R 1/2842; H04R 2201/02; H04R 2499/11; H04R 25/558; H04R 5/02; H04R 1/06; H04R 3/00; H04R 5/04; H04R 9/02; G06F 1/1616; G06F 1/1688
USPC ..... 381/87, 386, 333, 334, 388, 389, 394
See application file for complete search history.

(56) References Cited

U.S. PATENT DOCUMENTS

| | | | | |
|---|---|---|---|---|
| 6,081,421 A * | 6/2000 | Markow | G06F 1/1616 361/679.09 |
| 7,697,269 B2 | 4/2010 | Yang et al. | |
| 7,933,637 B2 * | 4/2011 | Gammon | H04M 1/035 381/355 |
| 2013/0070948 A1 * | 3/2013 | Lee | H04M 1/04 381/334 |

FOREIGN PATENT DOCUMENTS

| | | |
|---|---|---|
| JP | 2004-48223 A | 2/2004 |
| JP | 2012-44605 A | 3/2012 |

* cited by examiner

*Primary Examiner* — Davetta W Goins
*Assistant Examiner* — Phylesha Dabney
(74) *Attorney, Agent, or Firm* — Cha & Reiter, LLC.

(57) ABSTRACT

A speaker device and an electronic device including the speaker device. The speaker device includes a speaker body, which includes a front surface, a rear surface, and a side surface provided between the front surface and the rear surface, and a sealing member provided to enclose at least the side surface of the speaker body, in which the sealing member isolates sound output through the front surface of the speaker body and sound output through the rear surface of the speaker body from each other. The speaker device and the electronic device including the same may be implemented variously according to an embodiment.

21 Claims, 16 Drawing Sheets

SPEAKER DEVICE AND ELECTRONIC DEVICE INCLUDING THE SAME

CLAIM OF PRIORITY

This application claims priority under 35 U.S.C. §119(a) from Korean Patent Application Serial number 10-2014-0003991, which was filed on Jan. 13, 2014 in the Korean Intellectual Property Office, the entire disclosure of which is hereby incorporated by reference in its entirety.

BACKGROUND

1. Field of the Disclosure

Various embodiments of the present disclosure relate to an electronic device, and for example, a speaker device and an electronic device including the same.

2. Description of the Related Art

Speaker devices output sound and generally, the speaker devices are installed to be fixed in an enclosure (a.k.a. "case") having a predetermined space. Recently, however, speaker devices have been mounted in small-size electronic devices, such as mobile communication terminals, while providing high-quality sound. To secure such high-quality sound, a resonance space for sound generated by a speaker body is needed. The resonance space is provided around the speaker body to reinforce the sound output from the speaker body. In a small-size electronic device, a case for receiving the speaker body is provided to form a speaker module, thus providing the resonance space.

As the multimedia function of small-size electronic devices have increased, the size of a display device has also increased. In addition, much effort has been made to reduce a thickness of an electronic device for portability, together with the size increase of the display device.

The speaker device embodied in the form of a module receiving the speaker body in the case is useful for securing the resonance space, but may be difficult to mount within the thickness-reduced electronic device. Thus, the speaker body may be mounted inside the electronic device without using the case, and a part of an internal space of the electronic device may be reserved as the resonance space. However, in order to mount the speaker body inside the electronic device and secure the resonance space, a predetermined space inside the electronic device needs to be sealed.

In addition, in a structure of the electronic device where a plurality of elements, for example, a front case and a rear case are coupled, there may be a limitation in securing a sealing structure to provide a secured resonance space.

Moreover, in order to provide a secured resonance space, bonding may be performed to fix the speaker body within the electronic device, or to secure the sealing structure. Bonding has a shortcoming in that if the speaker body or other parts need to be replaced due to a failure or the like, the part and other parts bonded thereto may also need to be replaced.

The above information has been provided as background information only to assist with an understanding of the present disclosure. No determination has been made, and no assertion is made, as to whether any of the above might be applicable as prior art with regard to the present disclosure.

SUMMARY

Aspects of the present disclosure have been made to at least partially solve, alleviate, or remove at least one of problems and/or disadvantages described above.

Accordingly, various aspects of the present disclosure provide a speaker device capable of easily securing a resonance space and an electronic device including the speaker device.

Various aspects of the present disclosure also provide a speaker device that is easy to install, separate, and replace, and an electronic device including the speaker device.

Moreover, various aspects of the present disclosure provide a speaker device capable of saving costs for repair or the like by facilitating replacement, and an electronic device including the speaker device.

Other objects to be provided in the present disclosure may be understood by the various embodiments described herein below.

According to an aspect of the present disclosure, there is provided a speaker device including a speaker body, which has a front surface, a rear surface, and a side surface that is arranged between the front surface and the rear surface, and a sealing member positioned to enclose at least the side surface of the speaker body, in which the sealing member isolates sound that is output through the front surface of the speaker body from sound that is output through the rear surface of the speaker body.

According to another aspect of the present disclosure, there is provided an electronic device including a speaker device, the electronic device having a pair of case members mounted to face toward each other, a speaker body including a front surface, a rear surface, and a side surface that is arranged between the front surface and the rear surface, and a sealing member provided to enclose at least the side surface of the speaker body, in which the sealing member is mounted on a first case member of the case members, and the sealing member and the first case member isolate sound output through the front surface of the speaker body from sound output through the rear surface of the speaker body.

In addition, the electronic device may further include a sound output hole formed in a second case member of the case members and a sound waveguide formed in the sealing member to communicate with the sound output hole, in which the front surface of the speaker body is positioned to face the second case member and the sound output through the front surface of the speaker body is delivered to the sound output hole through the sound waveguide.

The sound output hole may extend from, for example, a surface of the second case member so as to pass through a side surface of the second case member.

The electronic device may further include a support rib formed on a surface of the first case member, in which the support rib has a closed-curve shape enclosing the sealing member.

The sealing member may be compressed between the speaker body and the support rib, thus forming a sealing structure.

Other aspects, advantages, and salient features of the disclosure will be understood by those skilled in the art from the following detailed description, which, taken in conjunction with the annexed drawings, discloses various embodiments of the present disclosure.

BRIEF DESCRIPTION OF THE DRAWINGS

The above and other aspects, features and advantages of embodiments of the present disclosure will become more apparent to a person of ordinary skill from the following description taken in conjunction with the accompanying drawings, in which.

Throughout the drawings, like reference numerals will be understood to refer to like parts, components, and structures.

DETAILED DESCRIPTION

Figure 1A:
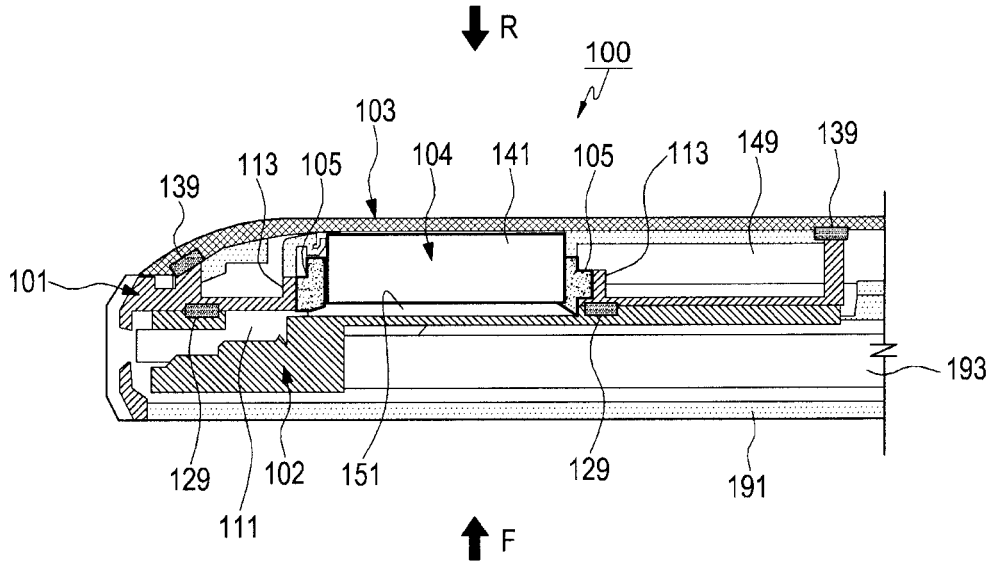
FIG. 1A is a cross-sectional view illustrating an electronic device including a speaker device according to one of various embodiments of the present disclosure.

The following detailed description with reference to the accompanying drawings is provided to assist a person of ordinary skill in the art in a comprehensive understanding of various embodiments of the present disclosure as defined by the claims and their equivalents. The detailed description includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness when their inclusion would obscure appreciation of the disclosure by a person of ordinary skill in the art.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purposes only and does limit the present disclosure as defined by the appended claims and their equivalents.

It is to be understood that the singular forms such as "a," "an," and "the" include plural referents unless the context clearly dictates otherwise. Thus, for example, reference to "a component surface" includes reference to one or more of such surfaces.

For the terms used in the various embodiments of the present disclosure, currently widely used general terms have been selected considering functions in the various embodiments of the present disclosure, but such terms may change according to intentions of those of ordinary skill in the art or cases, or emergence of new technologies. In special cases, there may be terms that are selected arbitrarily by the Applicant, and in these cases, meanings of such terms will be explained in detail in the detailed description of the various embodiments of the present disclosure. Therefore, the terms used in the various embodiments of the present disclosure may be defined based on the meanings of the terms by persons of ordinary skill in the art, and the overall contents of the various embodiments of the present disclosure, rather than simply based on names of the terms.

When a part "includes" a component in various embodiments of the present disclosure, the person of ordinary skill in the art should understand the meaning to be that the component may further include another component rather than excluding another component, unless the context clearly dictates otherwise.

Hereinafter, various embodiments of the present disclosure will be described in detail with reference to the accompanying drawings. However, the present disclosure is not limited by the various embodiments shown and described herein. Throughout the drawings, identical reference numerals refer to members that perform substantially identical functions.

A speaker device according to various embodiments of the present disclosure may include a speaker body that generates sound and a sealing member. The speaker body may include, for example, a front surface, a rear surface, and a side surface provided between the front surface and the rear surface. The sealing member is provided to enclose at least the side surface of the speaker body in such a way to isolate sound output through the front surface and sound output through the rear surface from each other.

An electronic device according to various embodiments of the present disclosure may include, for example, the speaker device and at least a pair of case members, in which the speaker device is mounted on a first case member of the case members. The first case member, together with the sealing member of the speaker device, functions to isolate the sound output through the front surface of the speaker body and the sound output through the rear surface of the speaker body from each other. The sealing member is compressed between the speaker body and the first case member to form a sealing structure.

[Embodiments]

Figure 1B:
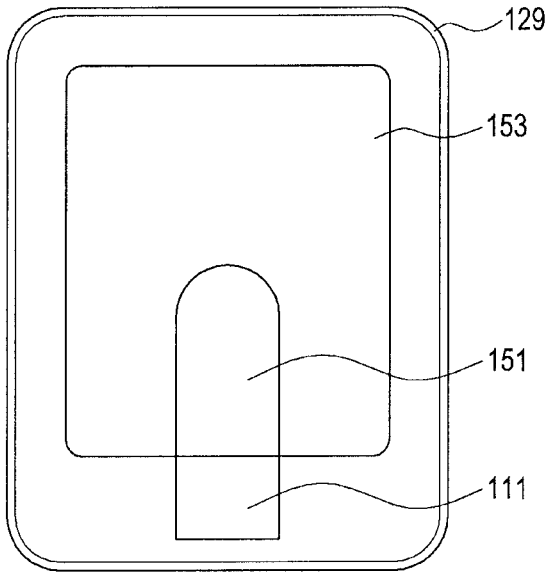
FIG. 1B is a floor plan illustrating a layout structure of a speaker device according to one of the various embodiments of the present disclosure.
Figure 2:
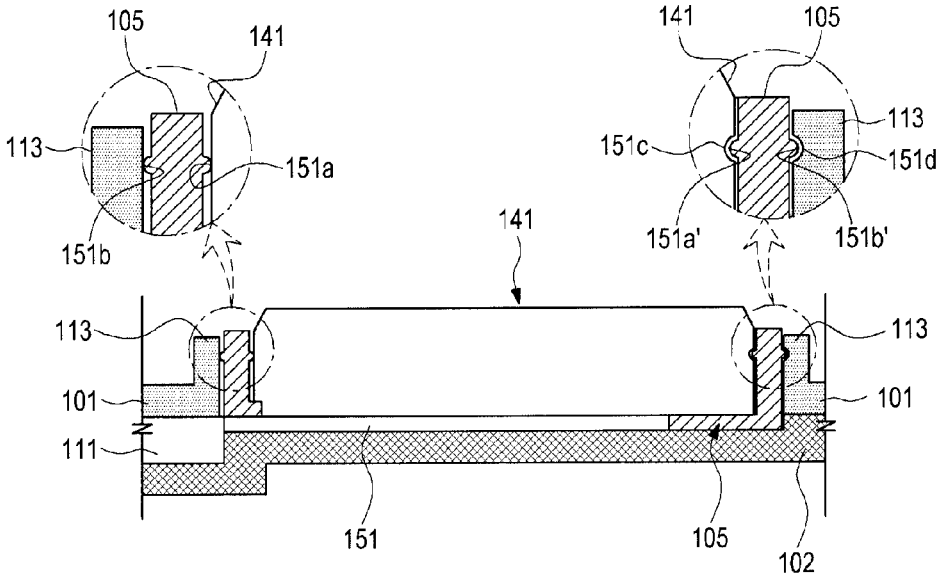
FIG. 2 is an enlarged cross-sectional view of a part of an electronic device including a speaker device according to one of the various embodiments of the present disclosure.

FIG. 1A is a cross-sectional view illustrating an electronic device including a speaker device according to an embodiment of the present disclosure. FIG. 1B is a floor plan for illustrating a layout structure of a speaker device according to one of embodiments of the present disclosure. FIG. 2 is a cross-sectional enlarged view of a part of an electronic device including a speaker device according to one of embodiments of the present disclosure.

As illustrated in FIGS. 1A and 2, an electronic device 100 according to one of embodiments of the present disclosure may include at least a pair of case members that are coupled to face each other. A first case member 101 of the case members is coupled to face a second case member 102 of the case members to provide an outer form of the electronic member 100. The second case member 102 receives a display module 193 on a front surface thereof. The display module 193 is protected by a window member 191 mounted on the second case member 102. The window member 191 passes a screen output from the display module 193 therethrough, and has a touch pad function according to an embodiment.

A speaker device 104 is mounted on the first case member 101. A support rib 113 is formed on a surface of the first case member 101 to provide a means for mounting and fixing the speaker device 104. The support rib 113, which is in a closed-curve shape enclosing the speaker device 104, protrudes from the surface of the first case member 101.

As shown in FIG. 2, once the speaker device 104 is mounted on the first case member 101 in a form enclosed by the support rib 113, the sealing member 105 is compressed between a speaker body 141 and the support rib 113 to form a sealing structure, and the speaker body 141 is positioned such that a front surface of the speaker body 141 faces the second case member 102.

At least one of sealing protrusions and protruding portions may be provided on an inner (first) surface and an outer (second) surface of the sealing member 105, respectively.

With continued reference to FIG. 2, the first sealing protrusion 151*a* from among a plurality of sealing protrusions have a closed-curve shape formed on the first surface of the sealing member 105 and is provided to enclose an outer circumferential surface of the speaker body 141. A second sealing protrusion 151*b* from among the plurality of sealing protrusions has a closed-curve shape formed on the second surface of the sealing member 105 and contacts an inner (adjacent) surface of the support rib 113. Although the sealing protrusions 151*a* and 151*b* are illustrated in this example as having semi-spherical cross-sections in FIG. 2, when the speaker device 104 is mounted on the support ribs 113, the sealing protrusions 151*a* and 151*b* are compressed to reinforce a sealing structure between the speaker body 141 and the first case member 101. Moreover, as the sealing member 105 is coupled to the speaker body 141, the first sealing protrusion 151*a* may be maintained in a compressed state. In consideration of the shape of the side surface of the speaker body 141, the sealing member 105 may be at least partially bonded to the speaker body 141 to complement the sealing structure.

A first protruding portion 151*a*' from among the plurality of protruding portions has a closed-curve shape formed on the inner surface of the sealing member 105 and is provided to enclose the outer circumferential surface of the speaker body 141. A second sealing protrusion 151*b*' from among the plurality of sealing protrusions has a closed-curve shape formed on the outer surface of the sealing member 105 and is provided to correspond to the inner surface of the support rib 113. Recessed portions 151*c* and 151*d* are formed in the speaker body 141 and the support rib 113 to correspond to the first protruding portion 151*a*' and the second protruding portion 151*b*'. If the speaker device 104 is installed in the first case member 101, the first protruding portion 151*a*' and the second protruding portion 151*b*' are engaged with the corresponding recessed portions 151*c* and 151*d*, respectively, to set an assembly position of the sealing member 105 with respect to the speaker body 141 and an assembly position of the speaker device 104 with respect to the first case member 101. If the first protruding portion 151*a*' and the second protruding portion 151*b*' have larger sizes than the corresponding recessed portions 151*c* and 151*d*, then formation of the sealing structure as well as setting of the assembly positions may be possible. For example, the first protruding portion 151*a*' and the second protruding portion 151*b*' may form a sealing structure, depending on their sizes, similarly with the first sealing protrusion 151*a* and the second sealing protrusion 151*b*.

When embodiments of the present disclosure are described, the examples show and describe the sealing protrusion 151*a* and the protruding portion 151*a*' being formed on the inner surface of the sealing member 105 and the sealing protrusion 151*b* and the protruding portion 151*b*' being formed on the outer surface of the sealing member 105, respectively. However, a plurality of sealing protrusions and a plurality of protruding portions may be arranged in various positions on the inner surface and the outer surface of the sealing member 105, respectively. For example, in FIG. 2, the plurality of sealing protrusions 151*a* and 151*b* and the plurality of protruding portions 151*a*' and 151*b*' may be arranged alternately in a direction from top to bottom of the sealing member 105. In addition, on the outer surface of the sealing member 105, the sealing protrusions 151*b* may be disposed at an upper end and a lower end of the sealing member 105 and the protruding portions 151*b*' may be disposed between the sealing protrusions 151*b*.

To output sound from the speaker device 104, the electronic device 100 may include a sound waveguide 151 and a sound output hole 111. If the first case member 101 and the second case member 102 are coupled to face each other when the speaker device 104 is mounted on the first case member 101, then the sound waveguide 151 may be formed between a front surface of the speaker device 104 and the second case member 102. Alternatively, the hole could be bounded by the first case member 101 and the second case member 102. The sound waveguide 151 may have a form so to an opening extending from the front surface of the speaker device 104 to a side edge of the speaker device 104.

The sound output hole 111 is formed in the second case member 102. The sound output hole 111 extends from a surface of the second case member 102 to penetrate through a side surface of the second case member 102. According to an embodiment, the sound output hole 111 may be formed to penetrate through the side surface of the second case member and another surface of the second case member 102 so as to permit the communication of sound through the waveguide and exits via the output hole, and a separate sound guide member may be installed to implement the shape of the sound output hole 111 illustrated in FIGS. 1A and 2.

To isolate a sound output path formed by the sound waveguide 151 and the sound output hole 111 from other regions, the electronic device 100 may further include a second sealing member 129 (as shown in FIG. 1A).

For example, a sound pressure may leak through a gap or space formed between the first case member 101 and the second case member 102, and by disposing the second sealing member 129 therebetween, such leakage may be prevented.

With reference to FIG. 1B, the second sealing member 129 is provided between the first case member 101 and the second case member 102, the second sealing member 129 may have a closed-curve shape that encloses a region where the sound waveguide 151 and the sound output hole 111 are formed on a surface of the second case member 102. The second sealing member 129 may be formed of an anti-vibration material such as a Poron® tape.

As shown in FIG. 1A, the electronic device 100 may further include a third case member 103. The third case member 103 may be coupled to face the second case member 102, with the first case member 101 being between the third case member 103 and the second case member 102. According to an embodiment, the third case member 103 may be detachable from the first case member 101. The third case member 103 may also be provided as two or more pieces. If the third case member 103 is provided as two or more pieces, any one piece of them may be assembled so as to be detachable (removable) from the first case member 101 and the other pieces may be assembled fixed to the first case member 101.

The third case member 103 is coupled to enclose the rear surface of the speaker device 104. In a region enclosing the rear surface of the speaker device 104 inside the third case member 103, a resonance space 149 may be formed. For example, a part of an inner surface of the third case member 103, the first case member 101, and the speaker device 104 may be combined to provide the resonance space 149. If the resonance space 149 is provided on the inner surface of the third case member 103, a third sealing member 139 may be further provided between the first case member 101 and the third case member 103. The third sealing member 139 is attached to one of the third case member 103 or the first case member 101 and so as to form an enclosure of the rear surface of the speaker device 104. Similar to the second sealing member, the third sealing member 139 may be formed of an anti-vibration material such as a Poron® tape.

Thus, the electronic device 100 according to embodiments of the present disclosure may secure a resonance space without a need to install a separate case. Moreover, the sealing member 105 and the first case member 101 may isolate sound output through the front surface of the speaker body 141 and sound output through the rear surface of the speaker body 141 from each other. Therefore, the electronic device 100 may provide sound of good quality in spite of being reduced in size and thickness.

Herein below, various implementation examples of the speaker device 104 will now be described with reference to FIGS. 3 through 29. In the following embodiments, identical elements or elements that may be easily understood from other embodiments will be referred to as identical reference numbers or will not be indicated by reference numerals and will not be described in detail.

Figure 3:
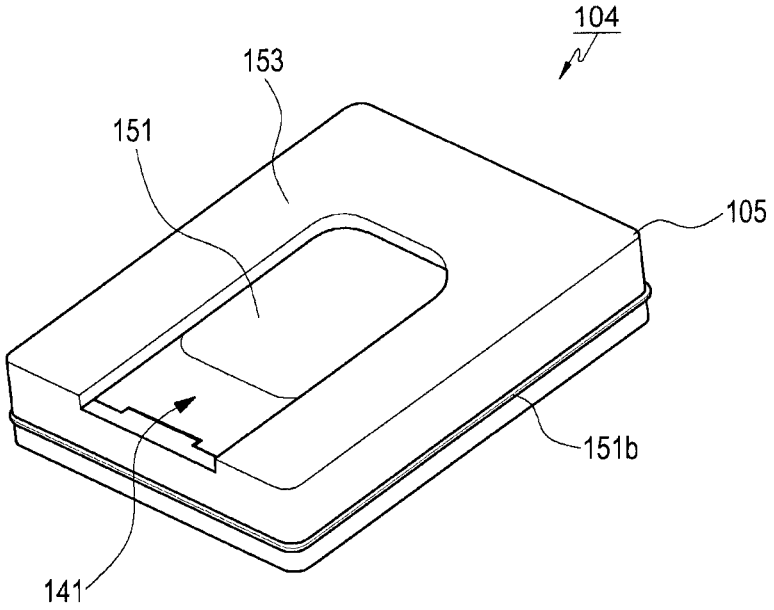
FIG. 3 is a perspective view illustrating a speaker device according to one of the various embodiments of the present disclosure.
Figure 4:
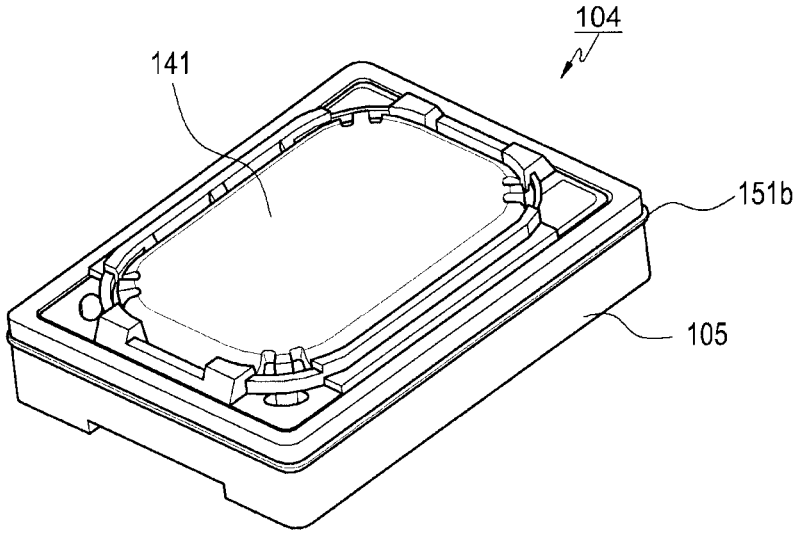
FIG. 4 is another perspective view illustrating a speaker device according to the various embodiments of the present disclosure.
Figure 5:
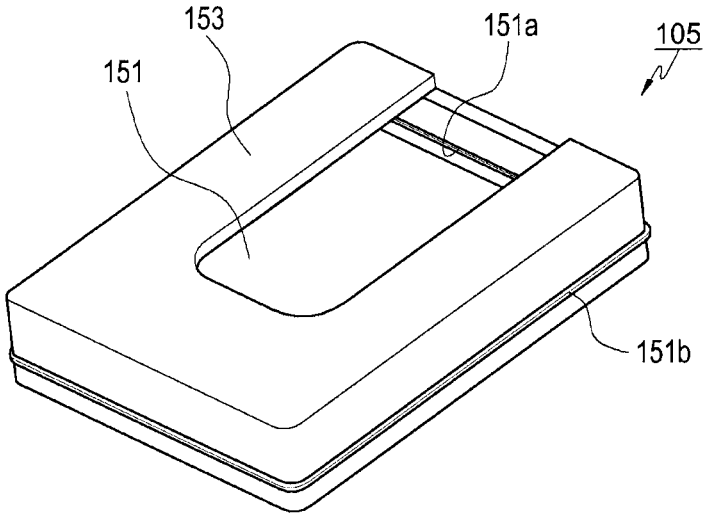
FIG. 5 is a perspective view illustrating a sealing member of a speaker device according to one of the various embodiments of the present disclosure.
Figure 6:
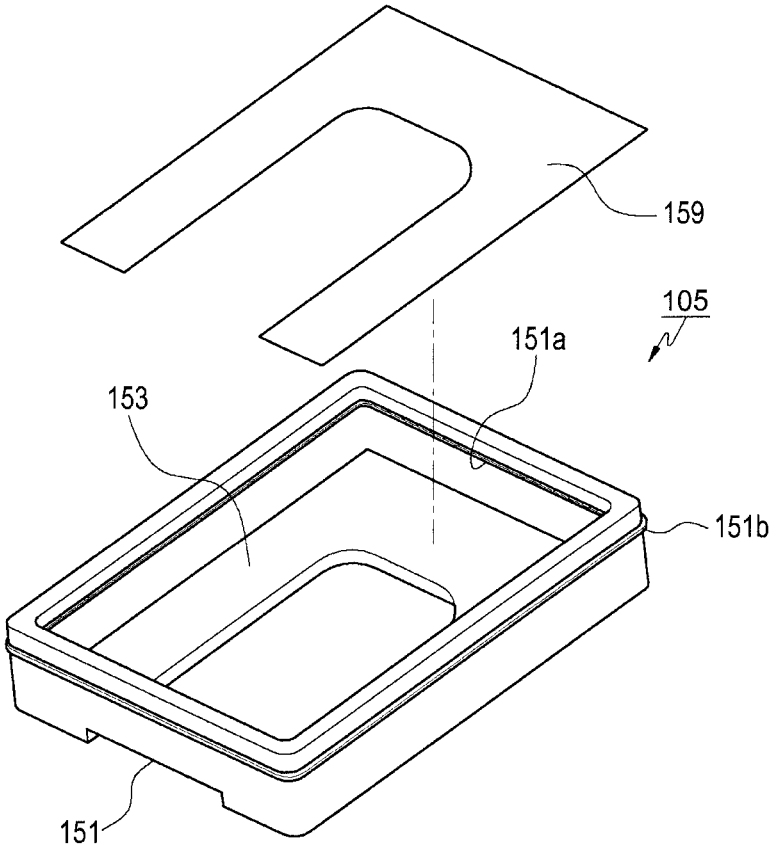
FIG. 6 is another perspective view illustrating a sealing member of a speaker device according to one of the various embodiments of the present disclosure.

FIG. 3 is a perspective view illustrating a speaker device according to one of embodiments of the present disclosure. FIG. 4 is another perspective view illustrating a speaker device according to one of embodiments of the present disclosure. FIG. 5 is still another perspective view illustrating a sealing member of a speaker device according to one of embodiments of the present disclosure. FIG. 6 is another perspective view illustrating a sealing member of a speaker device according to one of embodiments of the present disclosure.

Referring to FIGS. 3 through 6, the speaker device 104 may include the speaker body 141 and the sealing member 105.

The speaker body 141 may include a minimum of elements capable of substantially generating sound. The speaker device 104 according to embodiments of the present disclosure may be implemented using a speaker body having a complete structure capable of generating sound, and thus figures and a detailed description corresponding to a detailed structure of the speaker body 141 will not be provided.

The sealing member 105 is provided to enclose the side surface provided between the front surface and the rear surface of the speaker body 141, and is formed of an elastic material such as rubber, silicon resin, or the like. As the sealing member 105 is made of elastic material, the sealing member 105 is compressed to some degree when the speaker device 104 is mounted on the first case 101, such that the sealing member 105 stably fixes the speaker device 104 to the first case member 101, forming a sealing structure.

As previously-mentioned, the sealing member 105 may include the first sealing protrusion 151*a* and the second sealing protrusion 151*b* formed on the inner surface and the outer surface of the sealing member 105, respectively. The first sealing protrusion 151*a* and the second sealing protrusion 151*b* protrude from the inner surface and the outer surface of the sealing member 105, respectively, and form a closed curve extending along the circumferential direction of the sealing member 105. Although it is described above with reference to FIG. 2 that the protruding portions 151*a*' and 151*b*' are formed on the inner surface and the outer surface of the sealing member 105, respectively, the first sealing protrusion 151*a* and the second sealing protrusion 151*b* may be engaged with the recessed portion 151*c* formed in the outer surface of the speaker body 141 and the recessed portion 151*d* formed in the inner surface of the support rib 113 to replace the protruding portions 151*a*' and 151*b*'.

The sealing member 105 may include a cover member 153 that covers a part of the front surface of the speaker body 141. A double-sided tape is provided on an inner surface of the cover member 153 to attach the front surface of the speaker body 141 to the inner surface of the cover member 153. Thus, the speaker body 141 may be fixed in close contact with the sealing member 105.

A part exposing the front surface of the speaker body 141 in which the cover member 153 is not formed, may be used as the sound waveguide 151. For example, if the first case member 101 and the second case member 102 are coupled to face each other, the outer surface of the cover member 153 contacts the second case member 102, such that the sound waveguide 151 opened toward a side end of the sealing member 105 may be formed. In other words, the sound waveguide 151 may be formed between a part of the front surface of the speaker body 141, which is exposed to outside, and the second case member 102 to have the same thickness as that of the cover member 153. Thus, sound output through the front surface of the speaker body 141 is guided by the sound waveguide 151 to the sound output hole 111, and is isolated from sound output through the rear surface of the speaker body 141.

Figure 7:
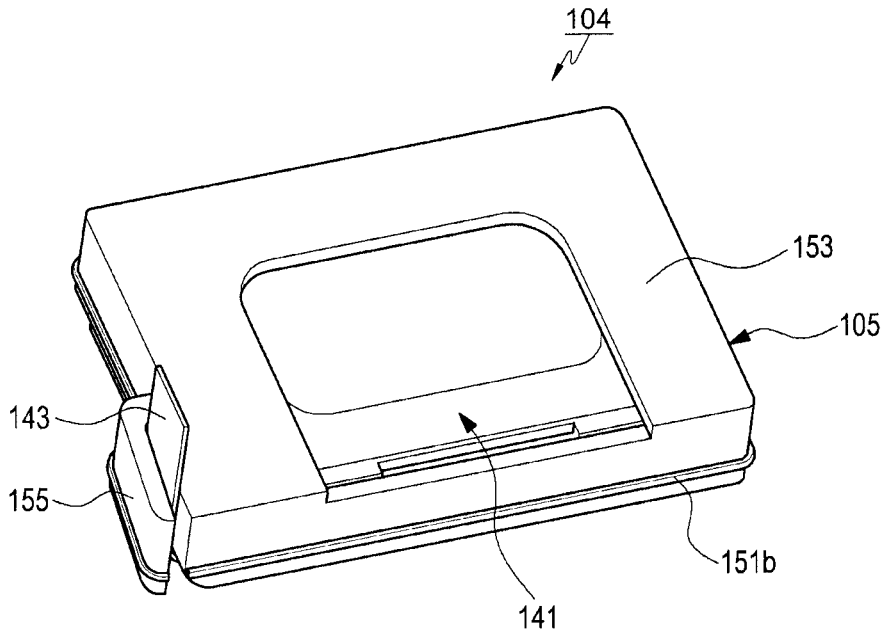
FIG. 7 is a perspective view illustrating a speaker device according to another one of the various embodiments of the present disclosure.
Figure 8:
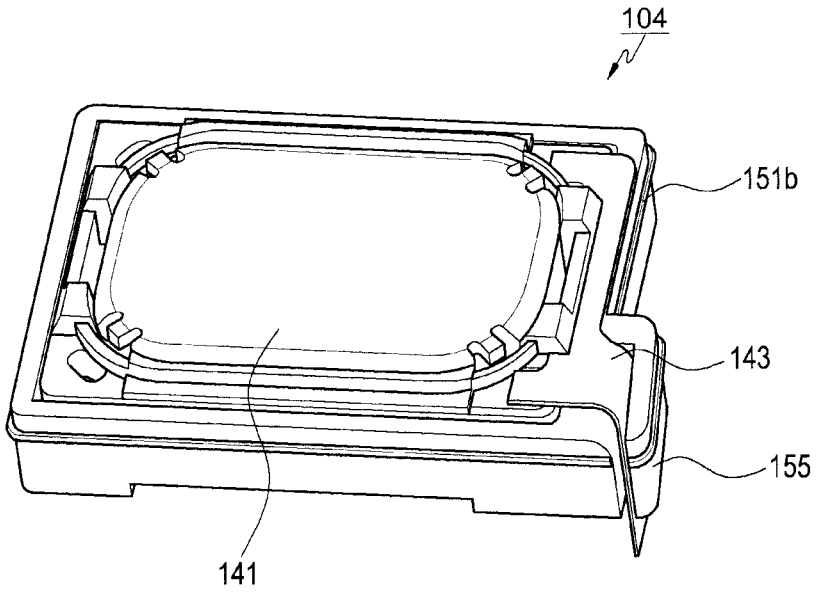
FIG. 8 is another perspective view illustrating a speaker device according to another one of the various embodiments of the present disclosure.
Figure 9:
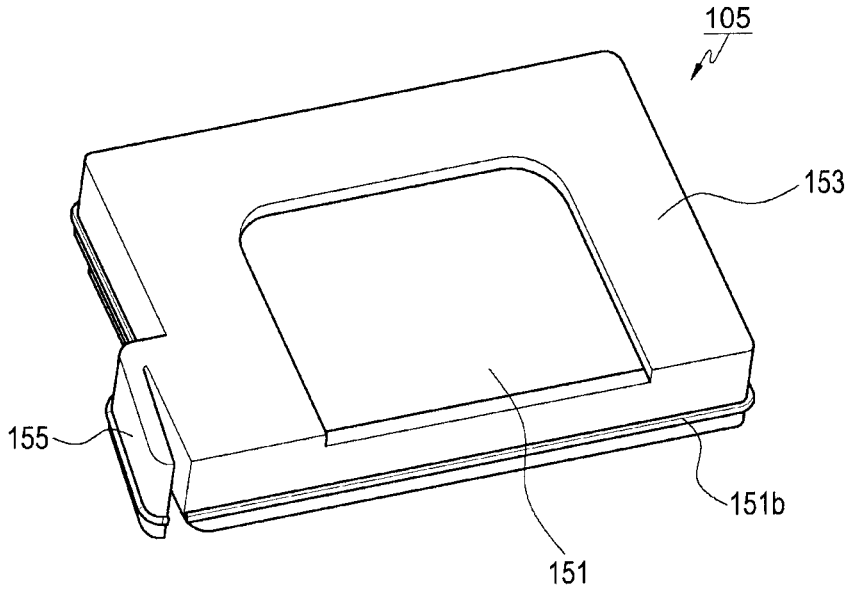
FIG. 9 is a perspective view illustrating a sealing member of a speaker device according to another one of the various embodiments of the present disclosure.

FIG. 7 is a perspective view illustrating a speaker device according to another one of various embodiments of the present disclosure. FIG. 8 is another perspective view illustrating a speaker device according to another one of various embodiments of the present disclosure without cover member 153, so that the speaker body 141 can be seen. FIG. 9 is a perspective view illustrating a sealing member of a speaker device according to another one of various embodiments of the present disclosure.

Figure 10:
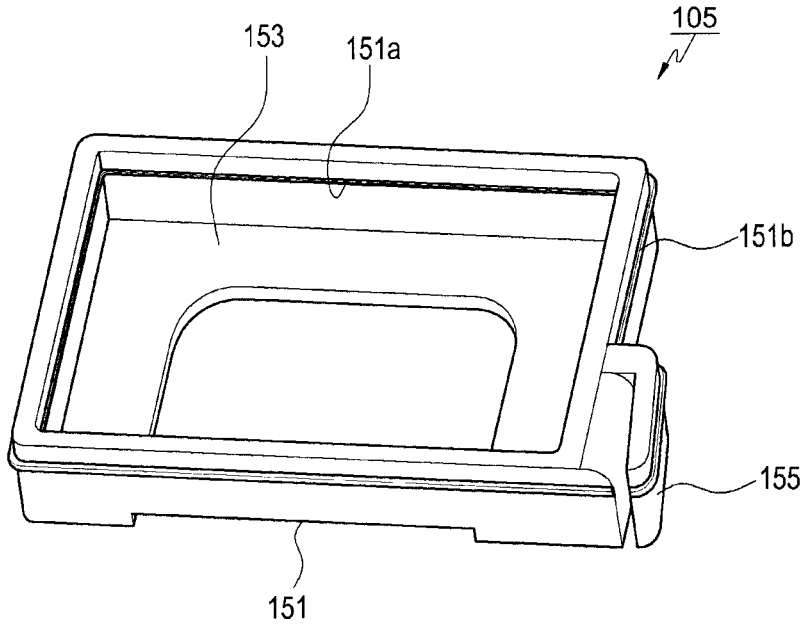
FIG. 10 is another perspective view illustrating a sealing member of a speaker device according to another one of the various embodiments of the present disclosure.

FIG. 10 is another perspective view illustrating a sealing member of a speaker device according to another one of various embodiments of the present disclosure.

The speaker device 104 according to the current embodiment is different from the previous embodiment in that the sealing member 105 provides a stable sealing structure while fixing a signal wire 143 extending from the speaker body 141. If the signal wire 143 needs to be disposed toward the front surface of the speaker body 141 while extending from the rear surface of the speaker body 141, a sealing structure may also be provided in a layout path of the signal wire 143. The signal wire 143 may be provided in various forms such as a Flexible Printed Circuit Board (FPCB), a coaxial cable, a conductive wire, and the like.

Referring to the illustrations shown in FIGS. 7 and 8, the signal wire 143 is disposed along the outer surface of the sealing member 105, extending from the rear surface of the speaker body 141. If the signal wire 143 is positioned between the sealing member 105 and the support rib 113, sealing performance between the signal wire 143 and the support rib 113 may be degraded. The speaker device 104 according to the current embodiment may provide a stable sealing structure while fixing the signal wire 143, by including a fixing member 155 formed on the outer surface of the sealing member 105. The fixing member 155 may extend, for example, integrally from the sealing member 105, and an end portion thereof may be provided as a free end with respect to the sealing member 105.

When the speaker device 104 is coupled to the first case member 101, the fixing member 155 is also coupled in a position enclosed by the support rib 113, such that the fixing member 155, together with the sealing member 105, is compressed in close contact with the outer circumferential surface of the signal wire 143. Thus, the signal wire 143 is fixed and a stable sealing structure may be formed between the speaker body 141 and the support rib 113. This sealing structure may secure more stable performance with sealing protrusions on the outer circumferential surface of the fixing member 155.

Figure 11:
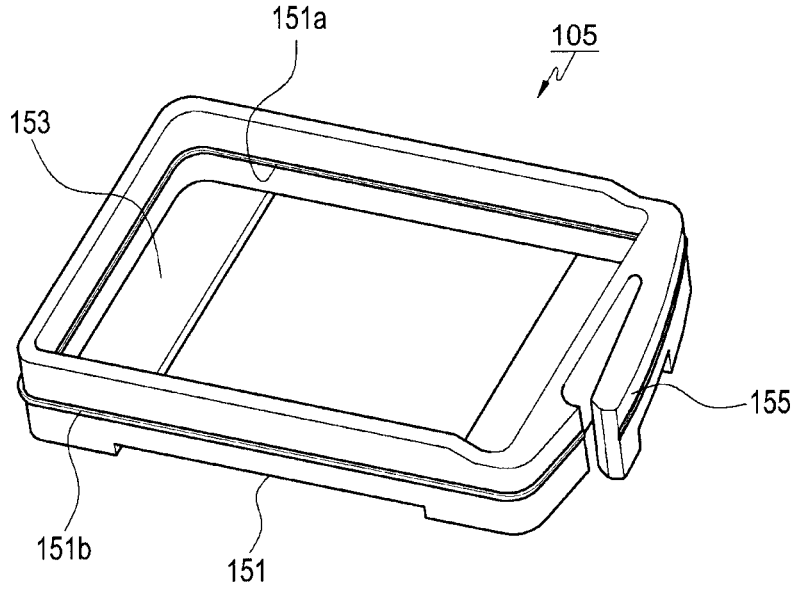
FIG. 11 is a perspective view illustrating a sealing member of a speaker device according to another one of the various embodiments of the present disclosure.
Figure 12:
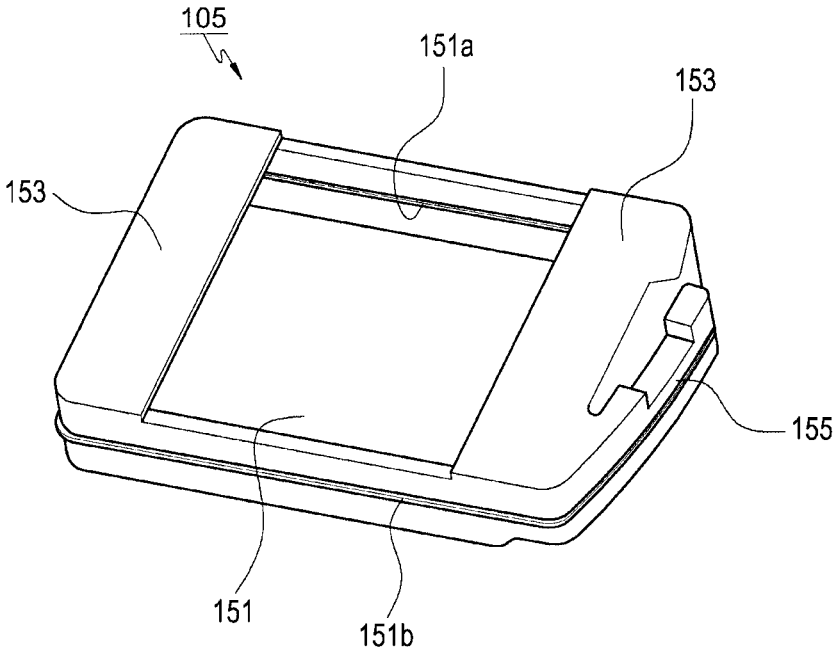
FIG. 12 is another perspective view illustrating a sealing member of a speaker device according to another one of the various embodiments of the present disclosure.
Figure 13:
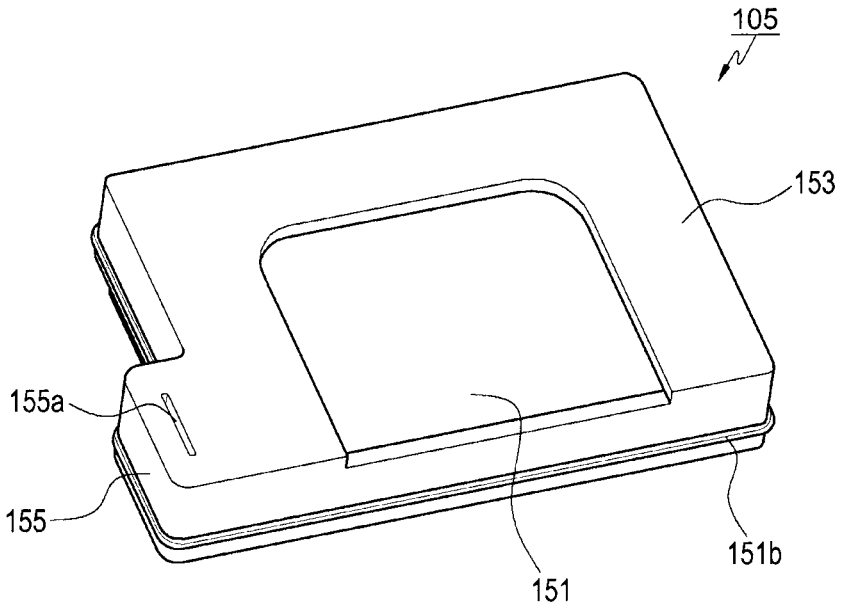
FIG. 13 is a perspective view illustrating a sealing member of a speaker device according to another one of the various embodiments of the present disclosure.
Figure 14:
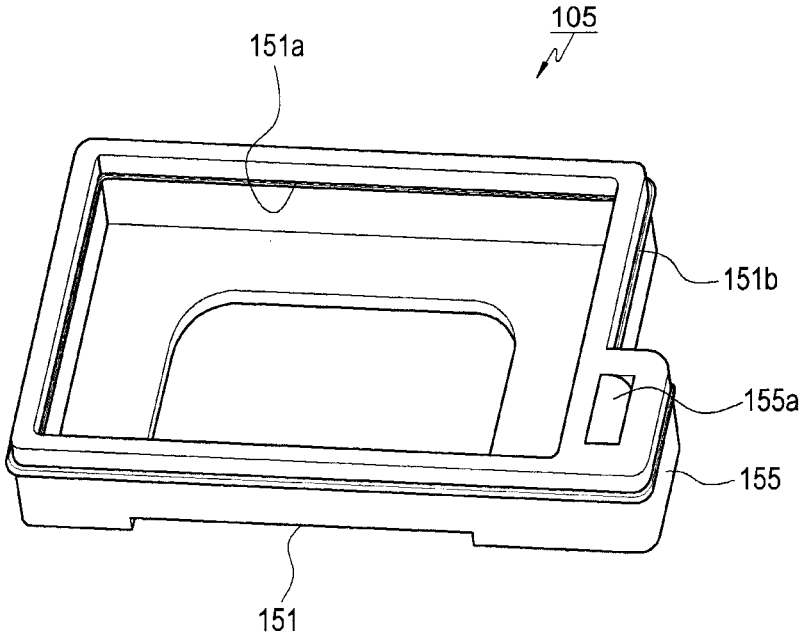
FIG. 14 is another perspective view illustrating a sealing member of a speaker device according to another one of the various embodiments of the present disclosure.

FIG. 11 is a perspective view illustrating another sealing member of a speaker device according to another one of the various embodiments of the present disclosure. FIG. 12 is another perspective view illustrating a sealing member of a speaker device according to another one of various embodiments of the present disclosure. FIG. 13 is a perspective view illustrating a sealing member of a speaker device according to another one of various embodiments of the present disclosure. FIG. 14 is still another perspective view illustrating a sealing member of a speaker device according to another one of various embodiments of the present disclosure. Comparing these figures, it appears there are differently sized sound waveguide 151. FIGS. 11 through 14 illustrate modified examples of the sealing member 105 that is illustrated in FIG. 7, and which are different from the sealing member 105 illustrated in FIG. 7 in shapes of the cover member 153 and the fixing member 155.

Referring now to FIGS. 11 and 12, the speaker device 104 may include the fixing member 155 formed, for example, by cutting a part of the sealing member 105. If the fixing member 155 is formed by cutting a part of the sealing member 105, the outer surface of the fixing member 155 may coincide with the outer surface of the sealing member 105 when the speaker device 104 is coupled to the first case member 101.

Referring now to FIGS. 13 and 14, both ends of the fixing member 155 are provided as fixing ends that are formed integrally with the sealing member 105. In this case, a through-hole 155*a* is formed in the fixing member 155 to provide a path along which the signal wire 143 passes.

The sealing member 105, according to at least the embodiments illustrated in FIGS. 11 through 14, may also provide a stable coupling and sealing structure by being compressed to some degree when the speaker device 104 is coupled to the first case member 101.

Figure 15:
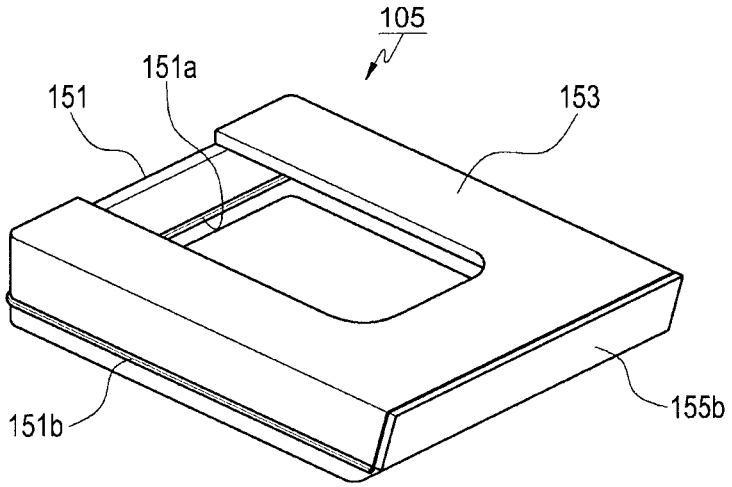
FIG. 15 is a perspective view illustrating a sealing member of a speaker device according to another one of the various embodiments of the present disclosure.
Figure 16:
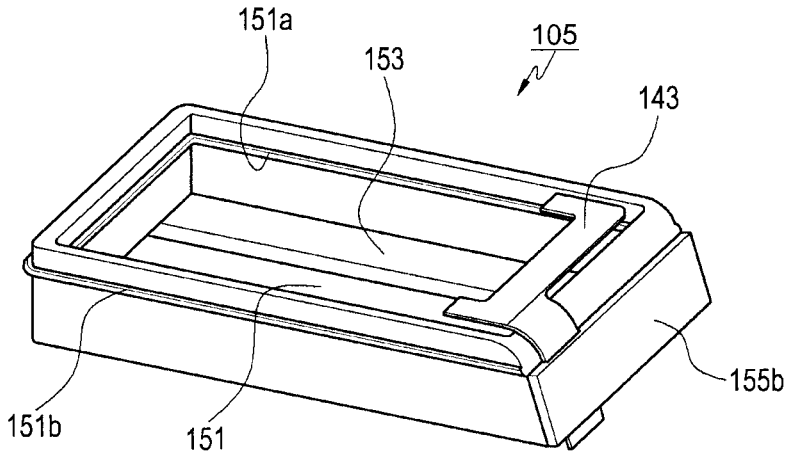
FIG. 16 is a perspective view illustrating a layout state of a signal wire in a sealing member of a speaker device according to another one of the various embodiments of the present disclosure.

FIG. 15 is a perspective view illustrating a sealing member of a speaker device according to yet another one of various embodiments of the present disclosure. FIG. 16 is a perspective view illustrating a layout state of a signal wire in a sealing member of a speaker device according to another one of various embodiments of the present disclosure.

Referring now to FIGS. 15 and 16, the speaker device 104 according to another one of the embodiments of the present disclosure may further include the fixing member 155 being attached to the sealing member 105 to provide the sealing structure while fixing the signal wire 143. For example, the signal wire 143 may extend to enclose the outer surface of the sealing member 105 and the fixing member 155 may be attached to the outer surface of the sealing member 105 to attach and fix a part of the signal wire 143 to the outer surface of the sealing member 105. The fixing member 155 may be formed of an anti-vibration material having elasticity, such as rubber, silicon resin, sponge, Poron®, or the like. As the fixing member 155 is formed of the material having elasticity, the fixing member 155 may be compressed together with the sealing member 105 to form a sealing structure when the speaker device 104 is coupled to the first case member 101.

Figure 17:
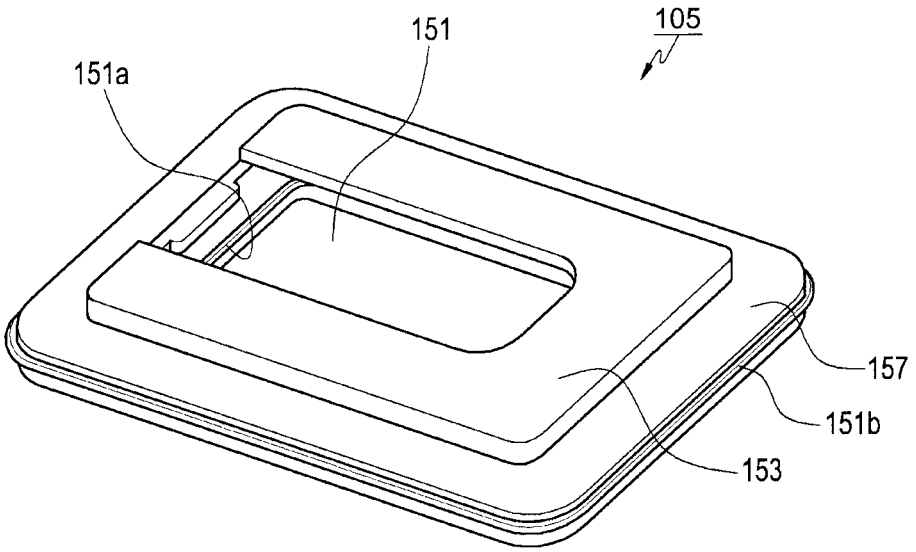
FIG. 17 is a perspective view illustrating a sealing member of a speaker device according to another one of the various embodiments of the present disclosure.
Figure 18:
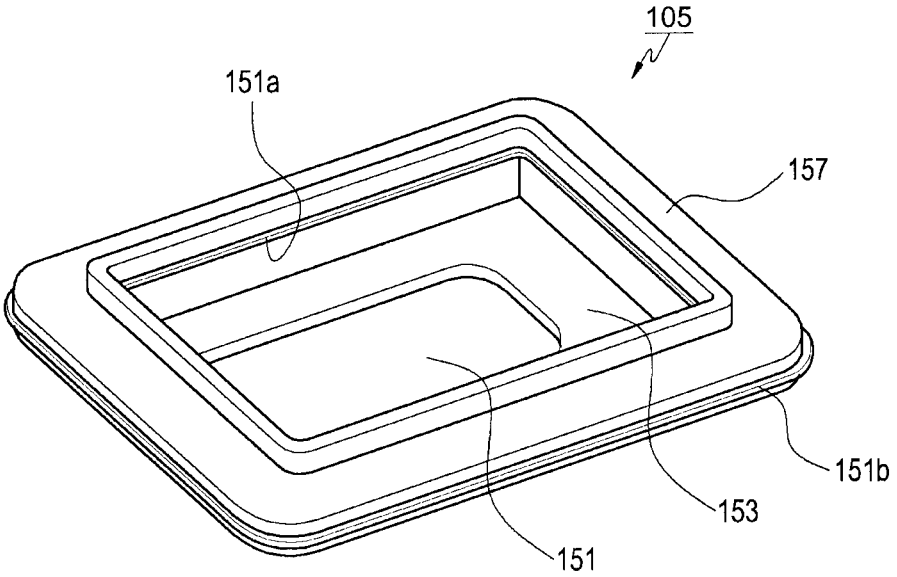
FIG. 18 is another perspective view illustrating a sealing member of a speaker device according to another one of the various embodiments of the present disclosure.

FIG. 17 is another perspective view illustrating a sealing member of a speaker device according to another one of the various embodiments of the present disclosure. FIG. 18 is another perspective view illustrating a sealing member of a speaker device according to another one of the various embodiments of the present disclosure.

As illustrated in FIGS. 17 and 18, the speaker device 104 according to the current embodiment may further include a rib 157 extending from the outer surface of the sealing member 105. The rib 157 may improve sealing performance by increasing a contact area when the sealing member 105 is coupled to the first case member 101. Moreover, the rib 157 may provide a mechanical fixing structure when the sealing member 105 is coupled and fixed to the first case member 101. The rib 157 providing such a mechanical fixing structure will be described in more detail with reference to FIGS. 19 and 20.

Figure 19:
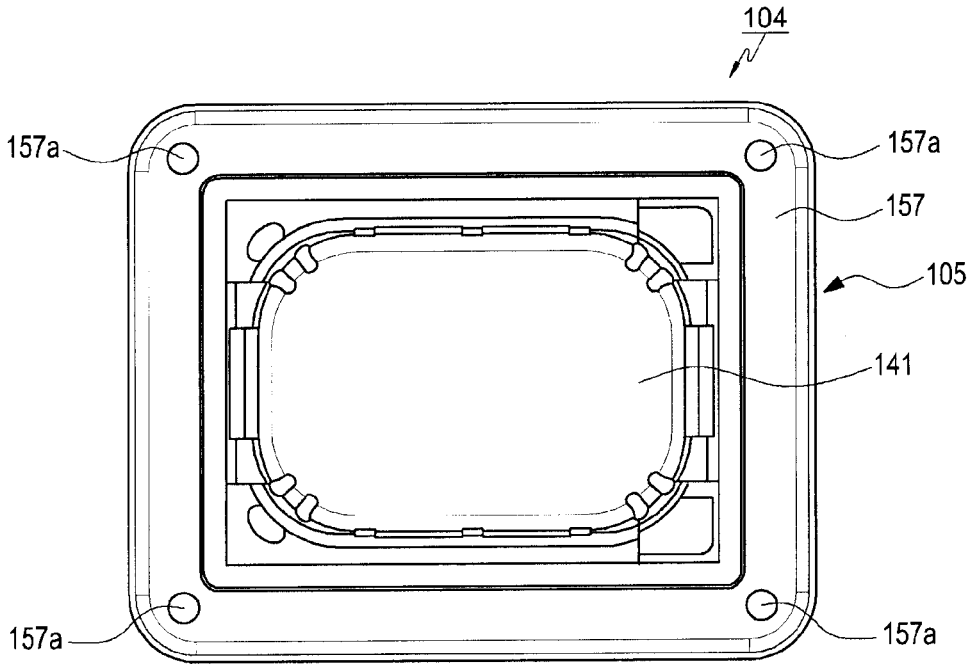
FIG. 19 is a floor plan illustrating a sealing member of a speaker device according to another one of the various embodiments of the present disclosure.
Figure 20:
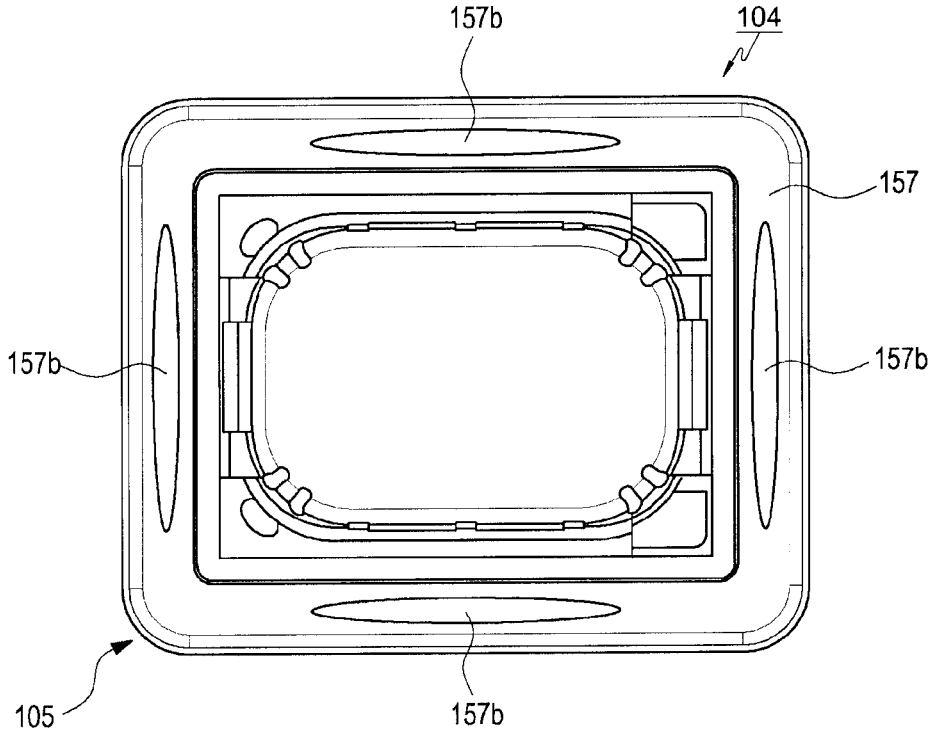
FIG. 20 is a floor plan illustrating a sealing member of a speaker device according to another one of the various embodiments of the present disclosure.

FIG. 19 is a plan view illustrating a sealing member of a speaker device according to another one of various embodiments of the present disclosure. FIG. 20 is a another plan view illustrating a sealing member of a speaker device according to another one of various embodiments of the present disclosure.

The sealing member 105 of the speaker device 104 illustrated in FIGS. 19 and 20 differs from that of the embodiment illustrated in FIG. 17 at least for the reason that the sealing member 105 illustrated in FIGS. 19 and 20 provides a mechanical fixing structure. For example, as illustrated in FIGS. 19 and 20, circular or elongated fixing holes 157*a* and 157*b* may be formed in the rib 157 of the sealing member 105. The shape of the first case member 101 or the mechanical fixing structure, for example, a fixing pin, may be provided to correspond to the sealing member 105.

Figure 21:
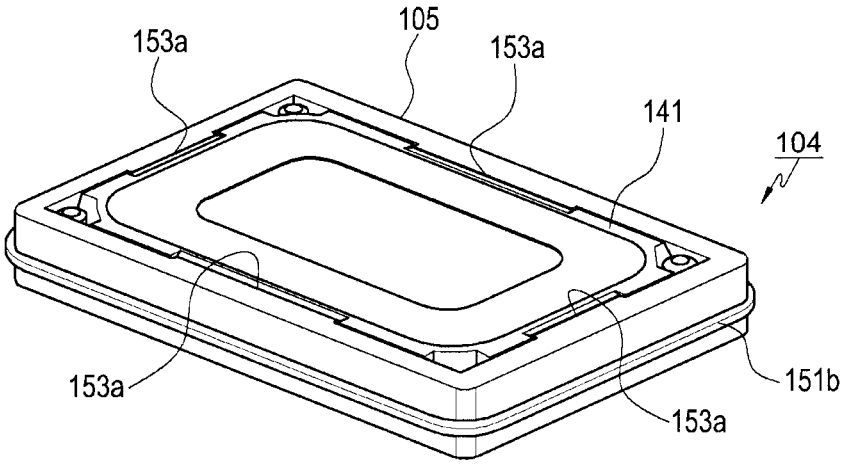
FIG. 21 is a perspective view illustrating a speaker device according to another one of the various embodiments of the present disclosure.
Figure 22:
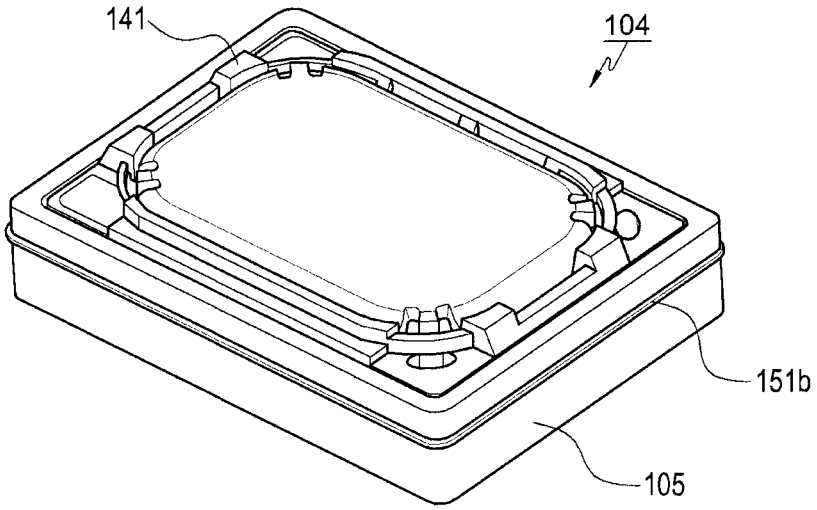
FIG. 22 is another perspective view illustrating a speaker device according to another one of the various embodiments of the present disclosure.
Figure 23:
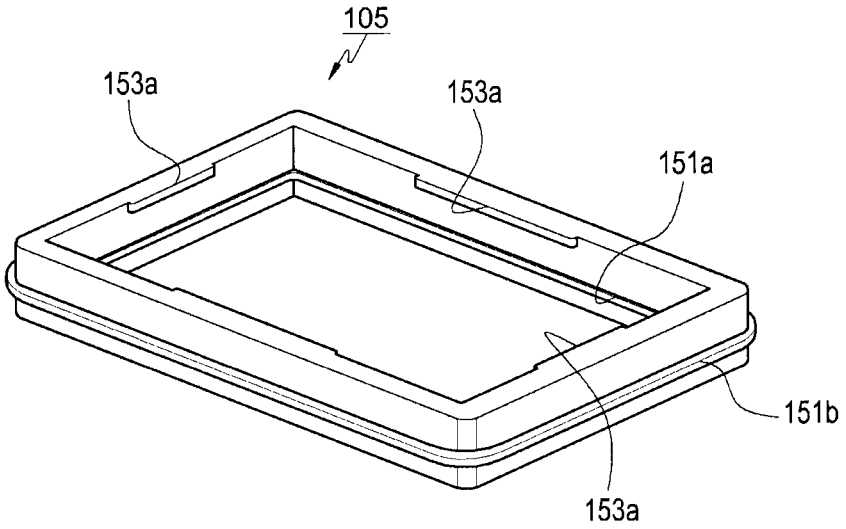
FIG. 23 is a perspective view illustrating a sealing member of a speaker device according to another one of the various embodiments of the present disclosure.
Figure 24:
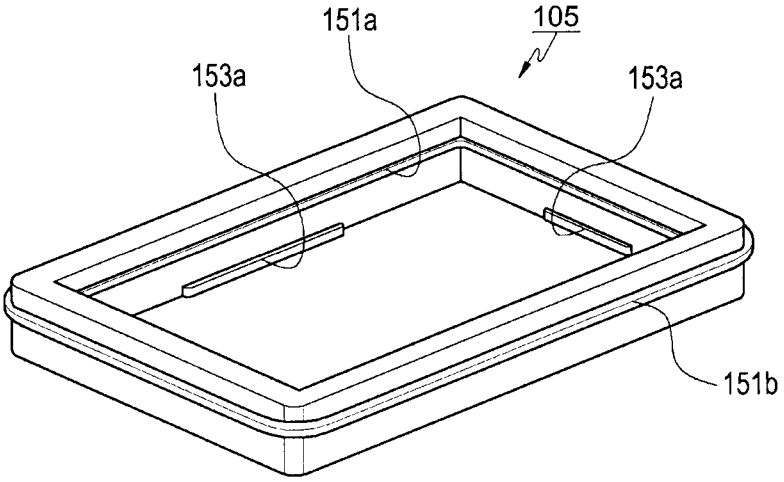
FIG. 24 is another perspective view illustrating a sealing member of a speaker device according to another one of the various embodiments of the present disclosure.

FIG. 21 is another perspective view illustrating a speaker device according to another one of the various embodiments of the present disclosure. FIG. 22 is another perspective view illustrating a speaker device according to another one of the various embodiments of the present disclosure. FIG. 23 is a perspective view illustrating a sealing member of a speaker device according to another one of various embodiments of the present disclosure. FIG. 24 is another perspective view illustrating a sealing member of a speaker device according to another one of various embodiments of the present disclosure.

The speaker device 104 illustrated in FIGS. 21 to 24 differs from the speaker device 104 according to at least some of the previous embodiments shown and described in that the front surface and the rear surface of the speaker device 141 are opened even when the speaker device 104 is coupled to the sealing member 105. However, the sealing member 105 includes support protrusions 153*a* to set and restrict a position at which the sealing member 105 is coupled to the speaker body 141. For example, the support protrusions 153*a* protruding from the inner surface of the sealing member 105 may be supported at an edge of the front surface of the speaker body 141 as illustrated in FIG. 21. If the support protrusions 153*a* formed on the sealing member 105 are supported on the front surface of the speaker body 141, the speaker body 141 may be assembled toward the front from the rear of the sealing member 105 (in a direction indicated by an arrow R in FIG. 1A).

The speaker device 104 according to the foregoing embodiments of the present disclosure may be assembled to the first case member 101 in a direction toward the front from the rear of the sealing member 105 (in the direction indicated by the arrow R in FIG. 1A). As the speaker device 104 is assembled in such a direction, the speaker body 141 may be more firmly coupled to the sealing member 105 in an assembly process of the speaker device 104.

Figure 25:
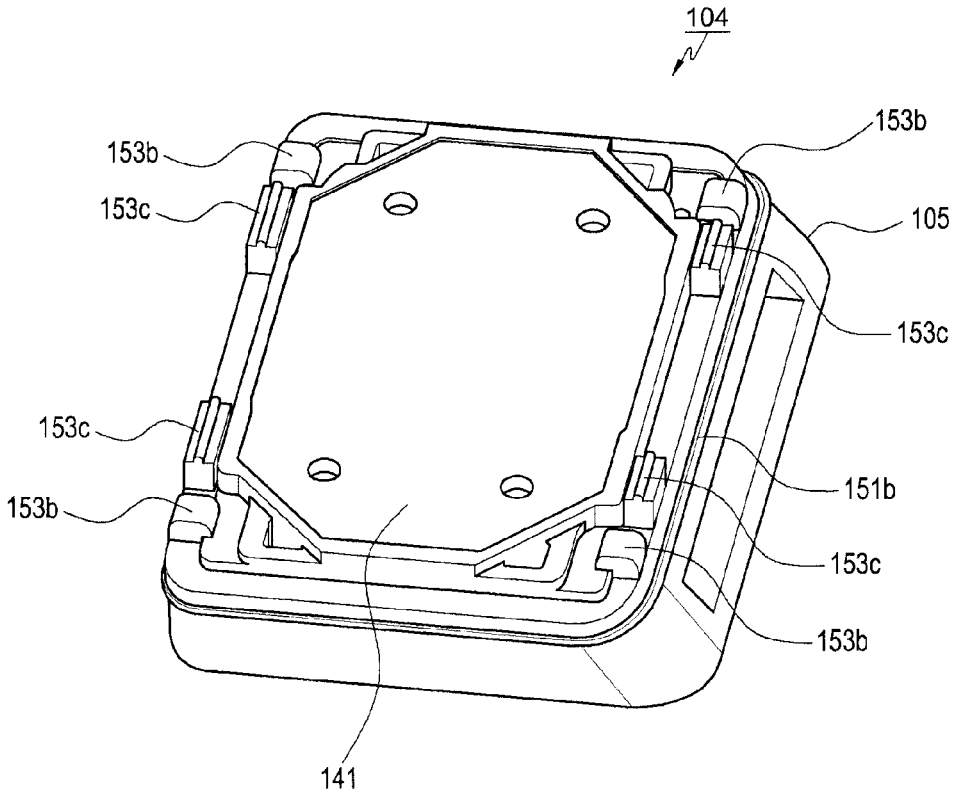
FIG. 25 is a perspective view illustrating a speaker device according to another one of the various embodiments of the present disclosure.

FIG. 25 is another perspective view illustrating a speaker device according to another one of the various embodiments of the present disclosure.

As illustrated in FIG. 25, support protrusions 153*b* formed on the sealing member 105 may be supported on the rear surface of the speaker body 141. In this case, the speaker body 141 may be assembled in a direction toward the rear from the front of the sealing member 105 (in a direction indicated by an arrow F in FIG. 1A). To prevent the rear surface of the speaker body 141 from directly contacting the third case member 103, a spacer 153*c* may be provided in the sealing member 105. The spacer 153*c* is formed so as to extend higher than the rear surface of the speaker body 141 from the sealing member 105, thus securing a predetermined interval between the rear surface of the speaker body 141 and the third case member 103. As the predetermined interval is secured between the rear surface of the speaker body 141 and the third case member 103, heat of the speaker body 141 may be easily released and sound may be smoothly output through the rear surface of the speaker body 141. Moreover, even if a shock is applied to the electronic device 100 due to dropping or the like, the shock may be prevented from being delivered to the speaker body 141.

Figure 26:
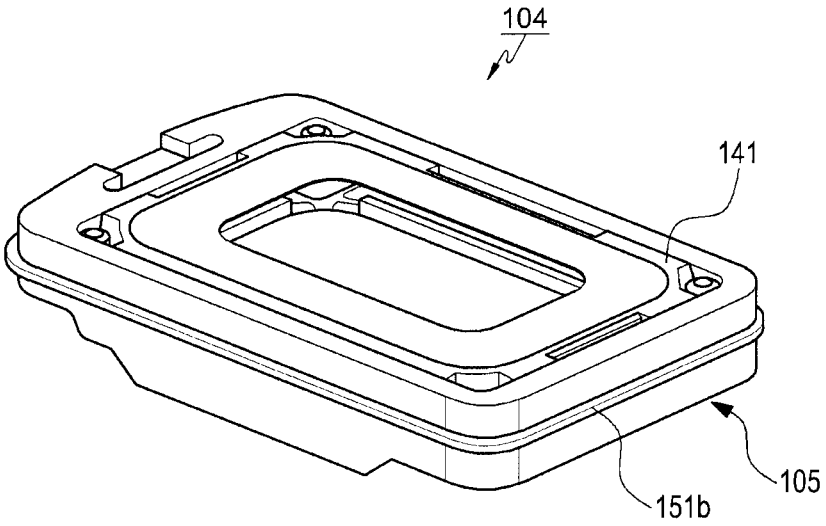
FIG. 26 is a perspective view illustrating a speaker device according to another one of the various embodiments of the present disclosure.
Figure 27:
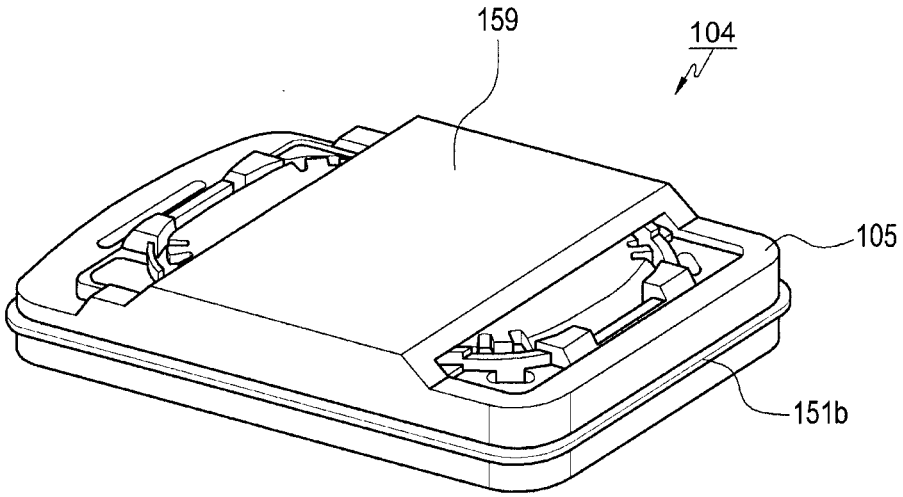
FIG. 27 is another perspective view illustrating a speaker device according to another one of the various embodiments of the present disclosure.
Figure 28:
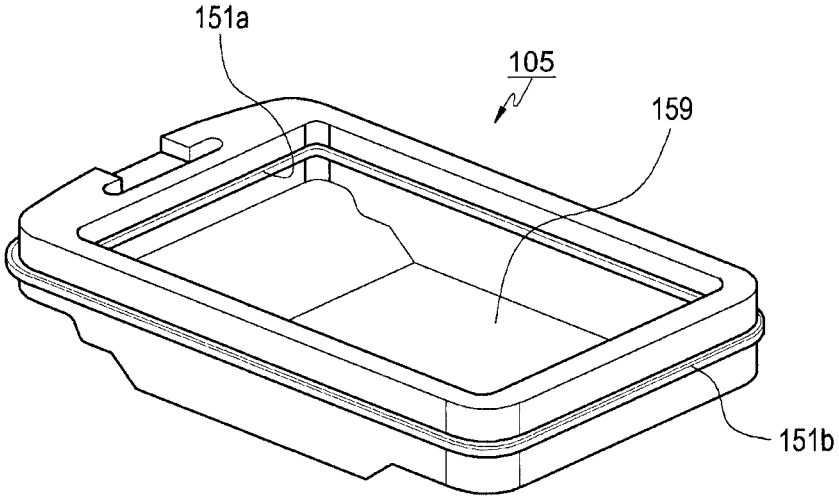
FIG. 28 is a perspective view illustrating a sealing member of a speaker device according to another one of the various embodiments of the present disclosure.
Figure 29:
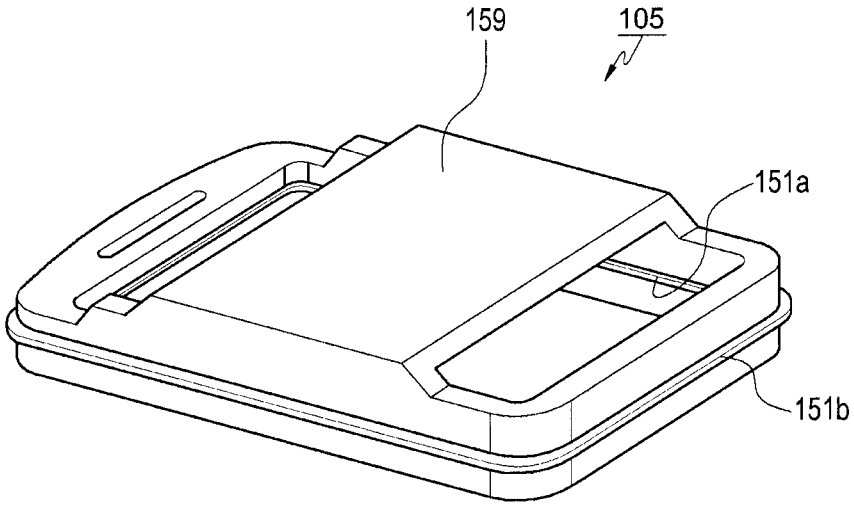
FIG. 29 is another perspective view illustrating a sealing member of a speaker device according to another one of the various embodiments of the present disclosure.

FIG. 26 is another perspective view illustrating a speaker device according to another one of the various embodiments of the present disclosure. FIG. 27 is another perspective view illustrating a speaker device according to another one of the various embodiments of the present disclosure. FIG. 28 is a perspective view illustrating a sealing member of a speaker device according to another one of various embodiments of the present disclosure. FIG. 29 is another perspective view illustrating a sealing member of a speaker device according to another one of the various embodiments of the present disclosure.

As illustrated in FIGS. 26 through 29, the speaker device 104 according to these embodiments of the present disclosure may further include a support member 159 formed in the sealing member 105. When the speaker body 141 is coupled, the support member 159 may cover a part of the rear surface of the speaker body 141. The speaker device 104 including the sealing member 105 facilitates the output of sound to be directed through the rear surface, and an interval between the third case member 103 and the speaker body 141 is secured to make it easy to release heat. To facilitate coupling of the speaker body 141, the front surface of the sealing member 105 may be opened. The speaker device 104 including the sealing member 105 may be coupled to the first case member 101 in a direction toward the rear from the front (in the direction as indicated by the arrow F in FIG. 1A).

As is apparent from the foregoing description, the speaker device according to the embodiments of the present disclosure includes a structure in which the sealing member is provided along the circumference of the speaker body, such that when the speaker device is mounted on the electronic device, the sealing member may be used. The sealing member provides a sealing structure between a structure of the electronic device and the speaker body, thereby easily isolating sound output through the front surface of the speaker body and sound output through the rear surface of the speaker body from each other and facilitating implementation of a resonance space inside the electronic device.

The speaker body or the speaker device may be easily removed from the electronic device, thus reducing costs associated with replacement due to a failure or the like.

Other effects that may be obtained or expected from the embodiments of the present disclosure are explicitly or implicitly disclosed in the detailed description of the embodiment of the present disclosure. For example, various effects expected from the embodiments of the present disclosure have been disclosed in the detailed description of the present disclosure.

While the present disclosure has been particularly shown and described with reference to exemplary embodiments thereof, various changes in form and detail may be made therein without departing from the spirit and scope of the present disclosure as defined by the following claims. Accordingly, the scope of the present disclosure will be defined by the appended claims and equivalents thereto.

For example, a structure for bonding the front surface of the speaker body to the inner surface of the cover member by using a bonding member such as a double-side tape on the inner surface of the cover member may also be applied to other embodiments, a bonding member may also be provided on the inner surface of the support member.

Although the fixing member is provided to form a sealing structure while disposing and fixing the signal wire in the foregoing embodiments, a wiring path passing through the sealing member may be provided. For example, a wiring path may be provided which passes from a lower end of the sealing member lying in parallel with the inner surface of the sealing member or the rear surface of the speaker body to an upper end of the sealing member lying in parallel with the front surface of the speaker body. Such wiring paths may be sealed as the sealing member is compressed when the speaker device is coupled to the first case member.

The above-described methods according to the present invention can be implemented in hardware, or loaded into hardware such as a processor controller, or that is stored on a non-transitory machine readable medium such as a CD ROM, a RAM, a floppy disk, a hard disk, or a magneto-optical disk or computer code downloaded over a network originally stored on a remote recording medium or a non-transitory machine readable medium and stored on a local non-transitory recording medium, so that the methods described herein are loaded into hardware such as a general purpose computer, or a special processor or in programmable or dedicated hardware, such as an ASIC or FPGA. As would be understood in the art, the computer, the processor, microprocessor controller, or the programmable hardware contain circuitry that may be integrated, and can include memory components, e.g., RAM, ROM, Flash, etc. that may store or receive computer code that when accessed and executed by the computer, processor or hardware implement the processing methods described herein. In addition, it would be recognized that when a general purpose computer accesses code for implementing the processing shown herein, via the execution of the code transforms the general purpose computer into a special purpose computer for executing the processing shown herein. In addition, an artisan understands and appreciates that a "controller", "processor" or "microprocessor" constitute hardware in the claimed invention and include integrated circuitry. Under the broadest reasonable interpretation, the appended claims constitute statutory subject matter in compliance with 35 U.S.C. §101 and none of the elements constitute software per se. Nor is the invention a mere abstract idea.

The terms "unit" or "module" as may be used herein is to be understood as constituting or operating in conjunction with hardware such as a circuit, integrated circuit, processor or microprocessor configured for a certain desired functionality in accordance with statutory subject matter under 35 U.S.C. §101, and such terms do not constitute software per se.

What is claimed is:

1. A speaker device comprising:

a speaker body comprising a front surface, a rear surface, and a side surface located between the front surface and the rear surface;

a signal wire extending from the speaker body;

a sealing member accommodating the speaker body while being in contact with the speaker body to seal within an enclosure at least the side surface of the speaker body; and a fixing member integrally extended from an outer surface of the sealing member, wherein the sealing member isolates sound that is output through the front surface of the speaker body from sound that is output through the rear surface of the speaker body and the signal wire is arranged on the outer surface of the sealing member and the fixing member contacts the outer surface of the sealing member, a portion of the signal wire being arranged between the fixing member and the sealing member, and wherein an end portion of the fixing member is provided as a free end with respect to the sealing member so that the signal wire is bent so as to emerge from a lateral side of a gap between the fixing member and the sealing member.

2. The speaker device of claim 1, further comprising a first sealing protrusion formed on an inner surface of the sealing member extending toward the side surface of the speaker body, wherein the first sealing protrusion has a closed-curve shape that encloses the side surface of the speaker body.

3. The speaker device of claim 1, further comprising a second sealing protrusion formed on the outer surface of the sealing member and extending away from the side surface of the speaker body, wherein the second sealing protrusion has a closed-curve shape that encloses the outer surface of the sealing member.

4. The speaker device of claim 1, wherein at least a part of the sealing member is bonded to the side surface of the speaker body.

5. The speaker device of claim 1, wherein the fixing member is formed of an anti-vibration material selected from the group consisting of rubber, silicon resin, sponge, and Poron®, and at least a portion of the fixing member is attached to the outer surface of the sealing member.

6. The speaker device of claim 1, further comprising:

a first protruding portion formed on an inner surface of the sealing member; and a recessed portion formed in the side surface of the speaker body, wherein the first protruding portion is engaged with the recessed portion.

7. The speaker device of claim 1, further comprising a second protruding portion formed on the outer surface of the sealing member.

8. The speaker device of claim 1, further comprising at least one support protrusion that is formed on the sealing member and is supported on the front surface or the rear surface of the speaker body.

9. The speaker device of claim 1, further comprising a cover member formed on the sealing member that covers a part of the front surface of the speaker body.

10. The speaker device of claim 9, further comprising a bonding member attached to an inner surface of the cover member, wherein the bonding member is attached to the front surface of the speaker body.

11. The speaker device of claim 1, further comprising a support member formed on the sealing member that covers a part of the rear surface of the speaker body.

12. An electronic device comprising a speaker device, the electronic device comprising:

a pair of case members mounted to face each other;

a speaker body comprising a front surface, a rear surface, and a side surface located between the front surface and the rear surface;

a sealing member accommodating the speaker body while being in contact with at least the side surface of the speaker body within the pair of case members;

a support rib formed on a surface of a first case member of the pair of case members, the support rib has a closed-curve shape enclosing the sealing member; and a protruding portion formed on an outer surface of the sealing member;

a recessed portion formed in the surface of the support rib, wherein when the sealing member is coupled to the first case member, the protruding portion is engaged with the recessed portion, and wherein the sealing member is mounted on the first case member, and the sealing member and the first case member isolate sound output through the front surface of the speaker body from sound output through the rear surface of the speaker body, and wherein the electronic device further comprises:

a signal wire extending from the speaker body and arranged on the outer surface of the sealing member; and a fixing member integrally extended from the outer surface of the sealing member, wherein the fixing member closely contacts the outer surface of the sealing member, with a portion of the signal wire arranged between the fixing member and the sealing member, and wherein an end portion of the fixing member is provided as a free end with respect to the sealing member so that the signal wire is bent so as to emerge from a lateral side of a gap between the fixing member and the sealing member.

13. The electronic device of claim 12, further comprising:

a sound output hole formed in a second case member of the pair of case members; and a sound waveguide formed in the sealing member to communicate with the sound output hole, wherein the front surface of the speaker body is positioned to face the second case member, and the sound output through the front surface of the speaker body is output to the sound output hole through the sound waveguide.

14. The electronic device of claim 13, wherein the sound output hole extends from a surface of the second case member and passes through a side surface of the second case member.

15. The electronic device of claim 13, further comprising a cover member formed on the sealing member that covers a part of the front surface of the speaker body, wherein the cover member is in contact with a surface of the second case member, and the sound waveguide is formed between at least a part exposed from the front surface of the speaker body and the second case member.

16. The electronic device of claim 13, further comprising a second sealing member located between the first case member and the second case member, wherein the second sealing member has a closed-curve shape enclosing the sound output hole and the sound waveguide on a surface of the second case member.

17. The electronic device of claim 12, further comprising a sealing protrusion formed on the outer surface of the sealing member, wherein the sealing protrusion has a closed-curve shape enclosing the outer surface of the sealing member and is in contact with a surface of the support rib.

18. The electronic device of claim 12, wherein the sealing member is compressed between the speaker body and the support rib to form a sealing structure.

19. The electronic device of claim 12, wherein the sealing member and the fixing member are compressed between the speaker body and the support rib to form a sealing structure.

20. The electronic device of claim 12, further comprising a third case member coupled to the first case member and facing a second case member, wherein a resonance space is formed by an enclosure formed by the first case member, the speaker body, and the third case member.

21. The electronic device of claim 20, further comprising a third sealing member located between the first case member and the third case member, wherein the third sealing member has a closed-curve shape provided along at least a circumference of the rear surface of the speaker body on a surface of the third case member.

* * * * *